US007832212B2

(12) United States Patent
Bunker

(10) Patent No.: US 7,832,212 B2
(45) Date of Patent: Nov. 16, 2010

(54) HIGH EXPANSION FUEL INJECTION SLOT JET AND METHOD FOR ENHANCING MIXING IN PREMIXING DEVICES

(75) Inventor: Ronald Scott Bunker, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 1041 days.

(21) Appl. No.: 11/558,760

(22) Filed: Nov. 10, 2006

(65) Prior Publication Data

US 2008/0110173 A1 May 15, 2008

(51) Int. Cl.
*F02C 1/00* (2006.01)
*F02G 3/00* (2006.01)

(52) U.S. Cl. ..... 60/737; 60/738; 60/748; 60/752

(58) Field of Classification Search ..... 60/737, 60/748, 740, 752; 239/399
See application file for complete search history.

(56) References Cited

U.S. PATENT DOCUMENTS 5,103,630 A * 4/1992 Correa ..... 60/791
6,094,916 A * 8/2000 Puri et al. ..... 60/737
6,772,595 B2 * 8/2004 Martling et al. ..... 60/737
6,865,889 B2 * 3/2005 Mancini et al. ..... 60/737
2002/0162333 A1 * 11/2002 Zelina ..... 60/776

OTHER PUBLICATIONS

U.S. Appl. No. 11/273,212, filed Nov. 14, 2005, Evulet.

* cited by examiner

*Primary Examiner*—Michael Cuff
*Assistant Examiner*—Craig Kim
(74) *Attorney, Agent, or Firm*—Global Patent Operation

(57) ABSTRACT

A premixing device includes an air inlet, at least one fuel inlet slot having a wall profile configured to form a fuel boundary layer along a portion of a wall of the premixing device, a mixing chamber, and at least one diverging fuel injection slot jet disposed inside the at least one fuel inlet slot, the slot jet being configured to create a flow separation region in a diverging portion thereof to generate mixing turbulence at an outlet of the slot jet to aerodynamically enhance a mixing of the fuel from the boundary layer with compressed air without causing a boundary layer flow separation and a flame holding in the mixing chamber. Low-emission combustors, gas turbine combustors, methods for premixing a fuel and an oxidizer in a combustion system, a gas turbine, and a gas to liquid system using the premixing device are also disclosed.

25 Claims, 6 Drawing Sheets

HIGH EXPANSION FUEL INJECTION SLOT JET AND METHOD FOR ENHANCING MIXING IN PREMIXING DEVICES

BACKGROUND OF THE INVENTION

1. Field of the Invention

Embodiments of the present invention relate in general to combustors and, more particularly, to premixing devices with high expansion fuel injection slot jets for enhanced mixing of fuel and oxidizer in low-emission combustion processes.

2. Description of the Related Art

Historically, the extraction of energy from fuels has been carried out in combustors with diffusion-controlled (also referred to as non-premixed) combustion where the reactants are initially separated and reaction occurs only at the interface between the fuel and oxidizer, where mixing and reaction both take place. Examples of such devices include, but are not limited to, aircraft gas turbine engines and aero-derivative gas turbines for applications in power generation, marine propulsion, gas compression, cogeneration, and offshore platform power to name a few. In designing such combustors, engineers are not only challenged with persistent demands to maintain or reduce the overall size of the combustors, to increase the maximum operating temperature, and to increase specific energy release rates, but also with an ever increasing need to reduce the formation of regulated pollutants and their emission into the environment. Examples of the main pollutants of interest include oxides of nitrogen ($NO_x$), carbon monoxide (CO), unburned and partially burned hydrocarbons, and greenhouse gases, such as carbon dioxide ($CO_2$). Because of the difficulty in controlling local composition variations in the flow due to the reliance on fluid mechanical mixing while combustion is taking place, peak temperatures associated with localized stoichiometric burning, residence time in regions with elevated temperatures, and oxygen availability, diffusion-controlled combustors offer a limited capability to meet current and future emission requirements while maintaining the desired levels of increased performance.

Recently, lean premixed combustors have been used to further reduce the levels of emission of undesirable pollutants. In these combustors, proper amounts of fuel and oxidizer are well mixed prior to the occurrence of any significant chemical reaction, thus facilitating the control of the above-listed difficulties of diffusion-controlled combustors. However, because a combustible mixture of fuel and oxidizer is formed before the desired location of flame stabilization, premixed combustor designers are continuously challenged with the control of any flow separation and/or flame holding in the regions where mixing takes place so as to minimize and/or eliminate undesirable combustion instabilities. Current design challenges also include the control of the overall length of the region where mixing of fuel and oxidizer takes place and the minimization of pressure drop associated with the premixing process. These challenges are further complicated with the need for combustors capable of operating properly with a wide range of fuels, including, but not limited to, natural gas, hydrogen, and synthesis fuel gases (also known as syngas), which are gases rich in carbon monoxide and hydrogen obtained from gasification processes of coal or other materials.

Conventional premixed burners incorporate fuel jets positioned between vanes of a swirler or on the surface of the vane airfoils. However, vortical structures formed at the fuel jet exits tend to pull oxidizer from the free stream under the fuel jet, resulting in the partial or total "blow-off" of the flow near the surface and creating a separation region in the main flow that could lead to premature ignition. In addition, this cross-flow injection of fuel generates localized regions of high and low concentrations of fuel/air mixtures within the combustor, thereby resulting in substantially higher emissions. Further, such cross-flow injection results in fluctuations and modulations in the combustion processes due to the fluctuations in the fuel pressure and the pressure oscillations in the combustor that may result in destructive dynamics within the combustion process. Recently, premixing devices using Coanda surfaces have been proposed as a way to minimize the negative effects of premixed combustors that depend primarily on cross-flow fuel injection to achieve a desired level of premixing and overall performance. In these devices, fuel injected along a Coanda surface adheres to the surface as the mainstream airflow is accelerated, preventing liftoff and separation of the fuel jets as well as undesirable pressure fluctuations that may cause combustion instability. In premixing devices with Coanda surfaces, the efficient mixing of the fuel with the oxidizer may be somewhat delayed since the fuel jet is maintained next to a diverging wall, thus potentially resulting in devices that are long in order to assure proper mixing of fuel and oxidizer. If the length of the premixing device is constrained by an overall engine length requirement, for example, the fuel concentration profile delivered to the flame zone may contain unwanted spatial variations, thus minimizing the full effect of premixing on the pollutant formation process as well as possibly affecting the overall flame stability in the combustion zone.

The undesirable effects of over-expansion in diverging flow passages is common knowledge in fluid mechanics; however, the use of a converging-diverging fuel injection slot jet with controlled localized flow separation with the intent of generating turbulence and fluid mixing at an injection site is unknown to this inventor. Therefore, a need exist for a premixing device for use in lean-premixed combustors with enhanced capabilities of mixing fuel and oxidizer while maintaining control of flow separation and flame holding in the mixing region of the combustor. The increased mixing performance will permit the development of premixing devices having a reduced length without substantially affecting the overall pressure drop of the system, premixed combustors incorporating such premixers being particularly suitable for use with fuels having a wide range of composition, heating values and specific volumes.

BRIEF SUMMARY OF THE INVENTION

One or more of the above-summarized needs and others known in the art are addressed by premixing devices that include an air inlet, a fuel inlet slot in flow communication with an end portion of the air inlet, the fuel inlet slot including a wall profile configured to form a fuel boundary layer along a portion of an inside wall of the premixing device, a mixing chamber where compressed air from the air inlet is mixed with fuel from the boundary layer, and a diverging fuel injection slot jet disposed inside the fuel inlet slot, the converging-diverging fuel injection slot jet being configured to create a flow separation region in a diverging portion thereof, the flow separation region being configured to generate mixing turbulence at an outlet of the diverging fuel injection slot jet to aerodynamically enhance a mixing of the fuel from the boundary layer with the compressed air without causing a boundary flow separation and a flame holding in the mixing chamber. Embodiments of the disclosed inventions also include low-emission combustors and gas turbine combustors having the above-summarized premixing devices.

In another aspect of the disclosed inventions, gas turbines are disclosed that include a compressor, a combustor in flow communication with the compressor configured to burn a premixed mixture of fuel and air, and a turbine located downstream of the combustor to expand the gas stream that exits the combustor. The combustors of such gas turbines include at least one premixing device having an air inlet, a fuel inlet slot in flow communication with an end portion of the air inlet, the fuel inlet slot including a wall profile configured to form a fuel boundary layer along a portion of an inside wall of the premixing device, a mixing chamber where compressed air from the air inlet is mixed with fuel from the boundary layer, and a converging-diverging fuel injection slot jet disposed inside the fuel inlet slot, the converging-diverging fuel injection slot jet being configured to create a flow separation region in a diverging portion thereof, the flow separation region being confined to the diverging portion and being configured to generate mixing turbulence at an outlet of the converging-diverging fuel injection slot jet to aerodynamically enhance a mixing of the fuel from the boundary layer with the compressed air without causing a boundary layer flow separation and a flame holding in the mixing chamber.

In another aspect of the disclosed inventions, gas-to-liquid systems are disclosed that include an air separation unit configured to separate oxygen from air, a gas processing unit for preparing natural gas, a combustor for reacting oxygen with the natural gas at an elevated temperature and pressure to produce a synthesis gas enriched with carbon monoxide and hydrogen gas, and a turbo-expander in flow communication with the combustor for extracting work from and for quenching the synthesis gas. The combustor of such gas-to-liquid systems including premixing devices disposed upstream of the combustor to facilitate the premixing of oxygen and the natural gas prior to reaction in the combustor, the premixing device including an air inlet, a fuel inlet slot in flow communication with an end portion of the air inlet, the fuel inlet slot including a wall profile configured to form a fuel boundary layer along a portion of an inside wall of the premixing device, a mixing chamber where compressed air from the air inlet is mixed with fuel from the boundary layer, and a converging-diverging fuel injection slot jet disposed inside the fuel inlet slot, the converging-diverging fuel injection slot jet being configured to create a flow separation region in a diverging portion thereof, the flow separation region being confined to the diverging portion and being configured to generate mixing turbulence at an outlet of the converging-diverging fuel injection slot jet to aerodynamically enhance a mixing of the fuel from the boundary layer with the compressed air without causing a boundary layer flow separation and a flame holding in the mixing chamber.

Methods for premixing a fuel and an oxidizer in a combustion system are also within the scope of the embodiments of the invention disclosed, such methods including the steps of drawing the oxidizer inside a premixing device through an oxidizer inlet, injecting the fuel into the premixing device through a diverging fuel injection slot jet, deflecting the injected fuel towards a pre-determined wall profile within the premixing device to form a fuel boundary layer along an inside wall of the premixing device, and premixing the fuel and oxidizer to form a fuel-air mixture, wherein the premixing includes over expanding the fuel in a diverging portion of the converging-diverging fuel injection slot jet to create a flow separation region in the diverging portion, the flow separation region being configured to generate mixing turbulence at an outlet of the diverging fuel injection slot jet to aerodynamically enhance a mixing of the fuel from the boundary layer with the oxidizer without causing a boundary layer flow separation and a flame holding in the mixing chamber.

The above brief description sets forth features of the present invention in order that the detailed description that follows may be better understood, and in order that the present contributions to the art may be better appreciated. There are, of course, other features of the invention that will be described hereinafter and which will be for the subject matter of the appended claims.

In this respect, before explaining several preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
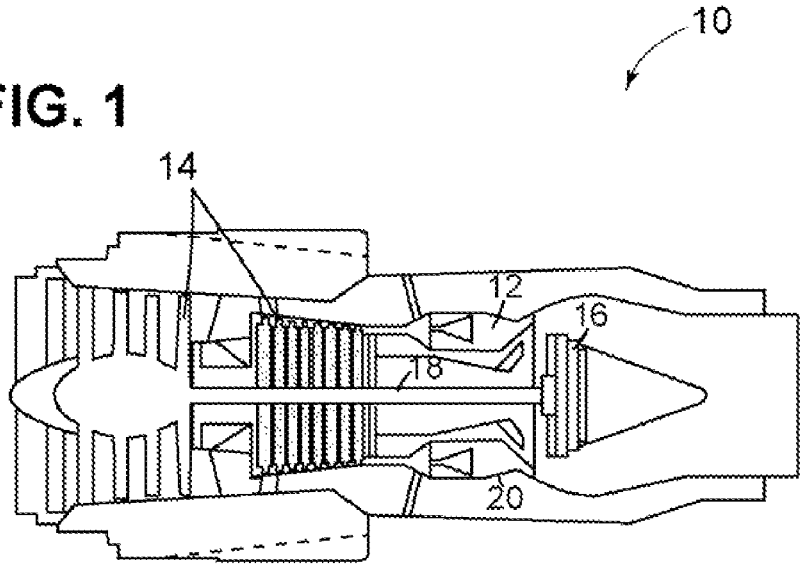
FIG. 1 is a diagrammatical illustration of a gas turbine having a combustor with a premixing device in accordance with aspects of the present technique.

Referring now to the drawings, wherein like reference numerals designate identical or corresponding parts throughout the different views, several embodiments of the premixing devices being disclosed will be described. In the explanations that follow, exemplary embodiments of the disclosed premixing devices used in a gas turbine will be used. Nevertheless, it will be readily apparent to those having ordinary skill in the applicable arts that the same premixing devices may be used in other applications in which combustion is primarily controlled by premixing of fuel and oxidizer.

FIG. 1 illustrates a gas turbine 10 having a compressor 14, which, in operation, supplies high-pressure air to a low-emission combustor 12. Subsequent to combustion of fuel injected into the combustor 12 with air (or another oxidizer), high-temperature combustion gases at high pressure exit the combustor 12 and expands through a turbine 16, which drives the compressor 14 via a shaft 18. As understood by those of ordinary skill in the art, references herein to air or airflow also refers to any other oxidizer, including, but not limited to, pure oxygen or a vitiated airflow having a volumetric oxygen content of less than 21% (e.g., 10%). In one embodiment, the combustor 12 includes a can combustor. In an alternate embodiment, the combustor 12 includes a can-annular combustor or a purely annular combustor. Depending on the application, the combustion gases may be further expanded in a nozzle (not shown) in order to generate thrust or gas turbine 10 may have an additional turbine (not shown) to extract additional energy from the combustion gases to drive an external load.

In the illustrated embodiment, the combustor 12 includes a combustor housing 20 defining a combustion area. In addition, the combustor 12 includes a premixing device for mixing compressed air and fuel prior to combustion in the combustion area. In particular, the premixing device employs a Coanda effect to enhance the efficiency of the mixing process. As used herein, the term "Coanda effect" refers to the tendency of a stream of fluid to attach itself to a nearby surface and to remain attached even when the surface curves away from the original direction of fluid motion.

Figure 2:
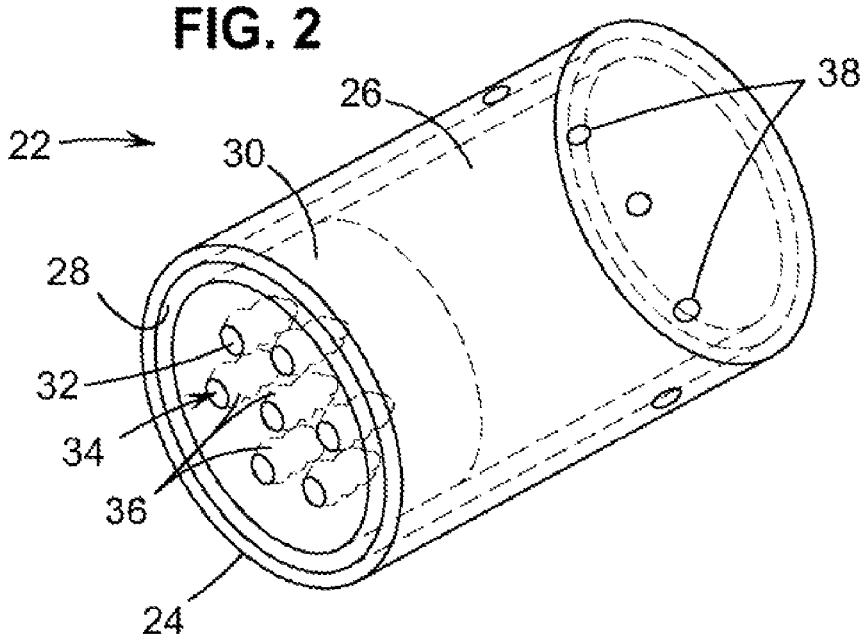
FIG. 2 is a diagrammatical illustration of an exemplary configuration of a can combustor employed in the gas turbine of FIG. 1 in accordance with aspects of the present technique.

FIG. 2 illustrates an exemplary configuration of a low-emission combustor 22 employed in the gas turbine 10 of FIG. 1. In the illustrated embodiment, the combustor 22 includes a can combustor. The combustor 22 includes a combustor casing 24 and a combustor liner 26 disposed within the combustor casing 24. The combustor 22 also includes a dome plate 28 and a heat shield 30 configured to reduce the temperature of the combustor walls. Further, the combustor 22 includes a plurality of premixing devices 32 for premixing the oxidizer and fuel prior to combustion. In one embodiment, the plurality of premixing devices 32 may be arranged to achieve staged fuel introduction within the combustor 22 for applications employing fuels such as hydrogen. In operation, the premixing device 32 receives an airflow 34, which is mixed with the fuel introduced into the premixing device 32 from a fuel plenum. Subsequently, the air-fuel mixture is burned in flames 36 inside the combustor 22. Dilution or cooling holes 38 may also be provided in the casing 24, as illustrated.

Figure 3:
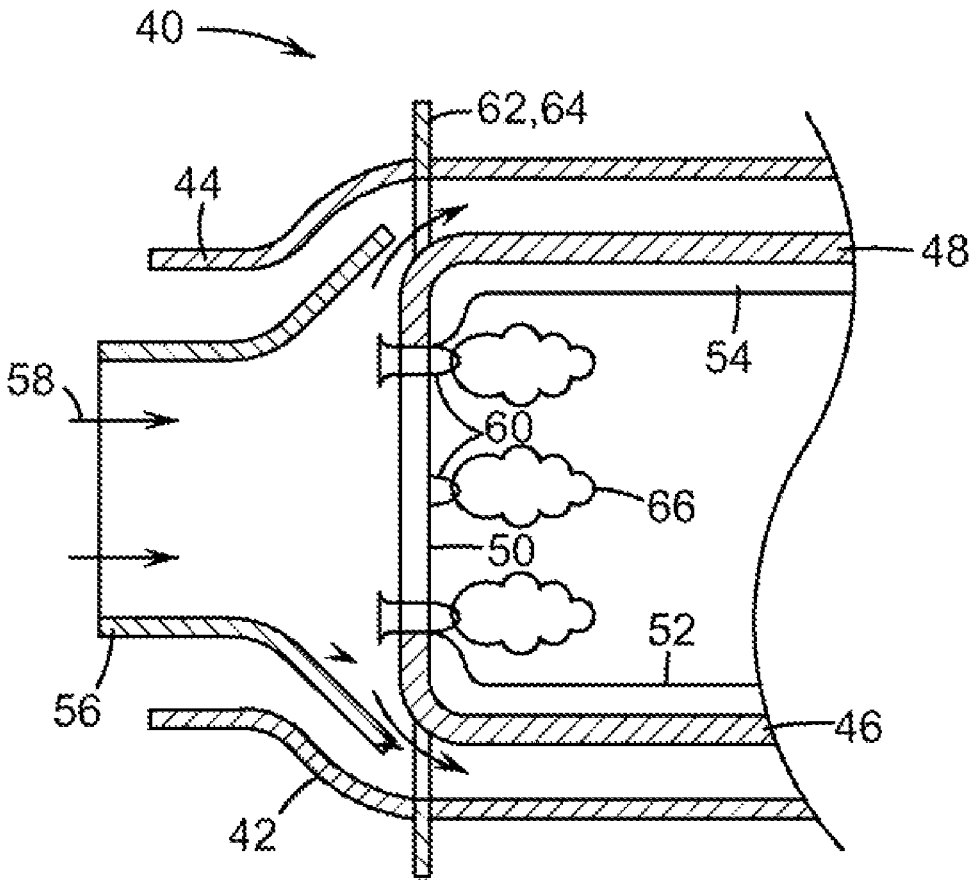
FIG. 3 is a diagrammatical illustration of another exemplary configuration of a annular combustor employed in the gas turbine of FIG. 1 in accordance with aspects of the present technique.

FIG. 3 illustrates another exemplary configuration of another low-emission combustor 40 employed in the gas turbine 10 of FIG. 1. In the illustrated embodiment, the combustor 40 includes an annular combustor. As illustrated, an inner casing 42 and an outer casing 44 define the combustion area within the combustor 40. In addition, the combustor 40 typically includes inner and outer combustor liners 46 and 48 and a dome plate 50. Further, the combustor 40 includes inner and outer heat shields 52 and 54 disposed adjacent to the inner and outer combustor liners 46 and 48 and a diffuser section 56 for directing an airflow 58 inside the combustion area. The combustor 40 also includes a plurality of premixing devices 60 disposed upstream of the combustion area. In operation, a respective premixing device 60 receives fuel from a fuel plenum via fuel lines 62 and 64, which fuel is directed to flow over a pre-determined wall profile inside the premixing device 60 for enhancing the mixing efficiency of the premixing device 60 by entraining air using the Coanda effect. Further, the fuel from the fuel lines 62 and 64 is mixed with the incoming airflow 58 and a fuel-air mixture for combustion is delivered to flame 66. In this embodiment, the introduction of fuel alters the air splits within the combustor 40. Particularly, the dilution air is substantially reduced and the combustion air split increases within the combustor 40 due to change in pressure generated by the Coanda effect.

Figure 4:
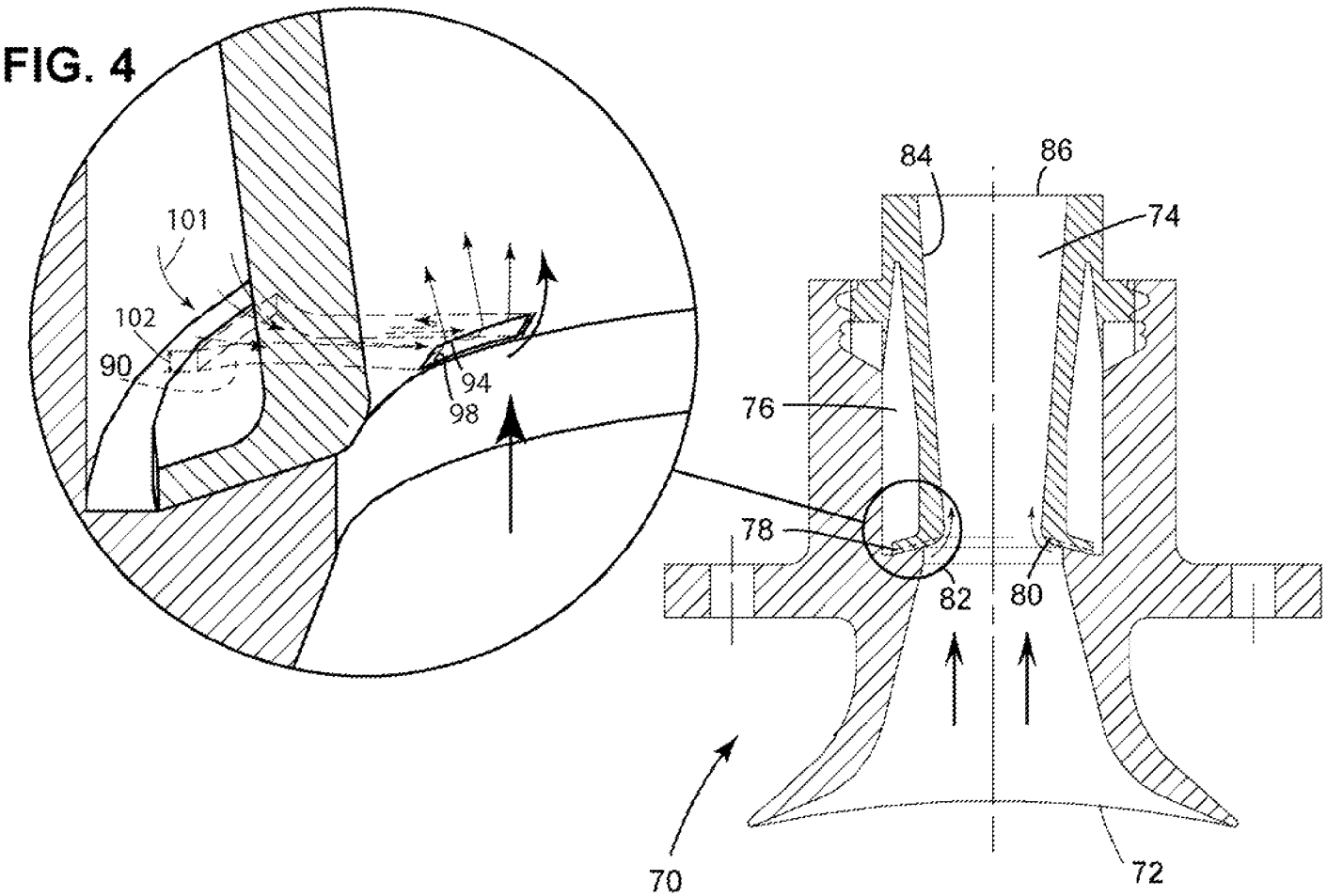
FIG. 4 is a cross-sectional view of an exemplary configuration of the premixing device employed in the combustor of FIG.1 with an converging-diverging slot jet in accordance with aspects of the present technique.

FIG. 4 is a cross-sectional view of an exemplary configuration of a premixing device 70 employed in the above-described combustors. In the embodiment illustrated in FIG. 4, the premixing device 70 includes an air inlet 72 configured to introduce compressed air into a mixing chamber 74. Further, the premixing device 70 includes a fuel plenum 76 from which fuel is provided to the mixing chamber 74 via a converging-diverging fuel injection slot jet 90 disposed in a circumferential slot 78. As understood by those of ordinary skill in the applicable arts, the slot 78 may be continuously or discretely disposed around the circumference of the premixing device 70. The enlarged portion of FIG. 4 illustrates qualitatively the disposition of the converging-diverging fuel injection slot jet 90 in the slot 78. In order to illustrate the three-dimensional nature of the fuel injection slot jet 90, the enlarged portion of FIG. 4 has been rotated. Further details of the fuel injection slot jet 90 will be further explained below in conjunction with FIG. 5.

The fuel introduced via the converging-diverging fuel injection slot jet 90 is deflected over a pre-determined wall profile 80, creating a fuel flow 82. In this exemplary embodiment, the premixing device 70 has an annular configuration and the fuel is introduced radially in and across the pre-determined wall profile 80. The geometry and dimensions of the pre-determined wall profile 80 may be selected/optimized based upon a desired premixing efficiency and the operational conditions including factors such as, but not limited to, fuel pressure, fuel temperature, temperature of incoming air, and fuel injection velocity. Examples of fuel include natural gas, high hydrogen gas, hydrogen, biogas, carbon monoxide and syngas. However, a variety of other fuels may be employed. In the illustrated embodiment, the pre-determined wall profile 80 causes the introduced fuel to attach to the wall profile 80 by the Coanda effect, thus forming a fuel boundary layer. This fuel boundary layer facilitates air entrainment, thereby enhancing the mixing efficiency within the mixing chamber 74 of the premixing device 70.

In the illustrated embodiment, the incoming air is introduced in the premixing device 70 via the air inlet 72. In certain embodiments, the flow of air may be introduced through a plurality of air inlets that are disposed upstream or downstream of the circumferential slot 78 to facilitate mixing of the air and fuel within the mixing chamber 74. Similarly, the fuel may be injected at multiple locations through a plurality of slots along the length of the premixing device 70. In another embodiment, the premixing device 70 may include a swirler (not shown) disposed upstream of the device 70 for providing a swirl movement in the air introduced in the mixing chamber 74. In another embodiment, a swirler (not shown) is disposed at the fuel inlet gap for introducing swirling movement to the fuel flow across the pre-determined wall profile 80. In yet another embodiment, the air swirler may be placed at the same axial level and co-axial with the premixing device 70, at the outlet plane from the premixing device 70.

Moreover, the premixing device 70 also includes a diffuser 84 having a straight or divergent profile for directing the fuel-air mixture formed in the mixing chamber 74 to the combustion section via an outlet 86. In one embodiment, the angle for the diffuser 84 is in a range of about +/−0 degrees to about 25 degrees. The degree of premixing of the premixing device 70 is controlled by a plurality of factors such as, but not limited to, the fuel type, geometry of the pre-determined wall profile 80, degree of pre-swirl of the air, size of the circumferential slot 78, fuel pressure, fuel temperature, temperature of incoming air, length and angle of the diffuser 84 and fuel injection velocity.

In operation, the pre-determined wall profile 80 facilitates the formation of a fuel boundary layer along the diffuser 84 while a portion of the airflow from the air inlet 72 is entrained by the fuel boundary layer to form a shear layer for promoting the mixing of the incoming air, or oxidizer, and fuel. In the illustrated embodiment, the fuel is supplied at a pressure relatively higher than the pressure of the incoming air. In one embodiment, the fuel pressure is about 1% to about 25% greater than the pressure of the incoming air at the air inlet 72.

The above-described fuel boundary layer is formed by a Coanda effect. In the illustrated embodiment, the fuel flow 82 attaches to the wall profile 80 and remains attached even when the surface of the wall profile 80 curves away from the initial fuel flow direction. More specifically, as the fuel flow accelerates around the wall profile 80 there is a pressure difference across the flow, which deflects the fuel flow 82 closer to the surface of the wall profile 80. As the fuel flow 82 moves across the wall profile 80, a certain amount of skin friction occurs between the fuel flow 82 and the wall profile 80. This resistance to the flow deflects the fuel flow 82 towards the wall profile 80, thereby causing it to remain close to the wall profile 80. Further, the fuel boundary layer formed by this mechanism entrains incoming airflow to form the shear layer to promote mixing of the airflow and fuel. U.S. patent application Ser. No. 11/273,212, commonly assigned to the assignee of this application, further discusses a premixing device having a Coanda surface. The contents of that patent application are incorporated herein by reference in its entirety.

Figure 5:
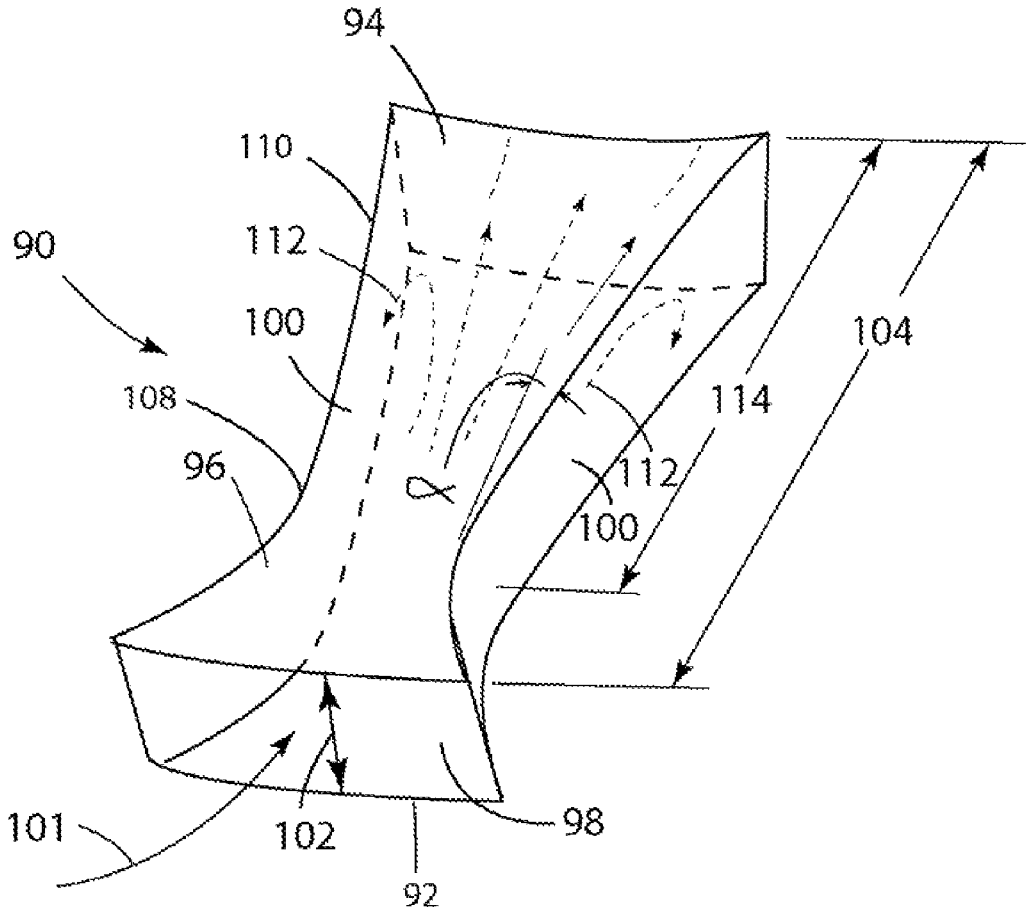
FIG. 5 illustrates a perspective view of the converging-diverging slot jet of FIG. 4.

The structural features of the converging-diverging fuel injection slot jet 90 disposed in the premixing device 70 are illustrated in FIG. 5. This converging-diverging fuel injection slot jet 90 serves to create a flow separation region 112 laterally inside the slot prior to injection into the oxidizer stream. The flow in the separation region 112 forces the fuel to expand and create mixing turbulence, thereby enhancing the mixing of fuel with the free stream flow of oxidizer in the mixing chamber. The converging-diverging fuel injection slot jet 90 includes a fuel inlet 92, a fuel outlet 94, a top wall 96, a bottom wall 98, and sidewalls 100. The height 102 of the converging-diverging fuel slot jet 90 measured in a direction perpendicular to the direction 101 of fuel flow is substantially constant along the length 104 of the slot jet 90, while the sidewalls 100 are shaped laterally so as to form a converging portion 106 from the inlet 92 to a throat 108 and a diverging portion 110 extending downstream of the throat 108 to the outlet 94.

In operation, the fuel is first accelerated in the converging portion 106 of the converging-diverging slot jet 90 toward the throat 108 followed by an over-expansion in the diverging portion 110 of the slot, thereby creating the flow separation region 112 laterally inside the slot prior to injection into the oxidizer stream at the outlet 94. As illustrated, separation occurs inside the slot, forcing the fuel to expand and create mixing turbulence. As understood by those of ordinary skill in the art, the increased level of turbulence created by the localized separation of the flow at 112 will increase the level of mixing of the injected fuel with the free stream flow of oxidizer at the outlet 94 of the converging-diverging fuel injection slot jet 90. The additional turbulence generated by the localized separation region 112 enhances the mixing of fuel and oxidizer in the region outside the slot outlet 94 while still avoiding the liftoff of the fuel jet as the same exits the slot. The geometry for the fuel injection passages is configured to promote mixing of the fuel and oxidizer from the exit of the slot jets, due at least to the fluid dynamics occurring inside the slot jet geometry. One of ordinary skill in the application arts will understand that it is not a requirement that the slot have a converging portion 106. When a converging portion 106 is provided, a throat region is normally formed so as to allow for metering the flow and preventing any flashback and a converging-diverging slot may be easier to manufacture and possess reduced flow losses. But in general, the inlet of the slot could be a constant cross section for some length, followed by the divergent portion. The entry of the slot could also be rounded, which in effect would serve as a throat.

The divergence angle a of the converging-diverging fuel injection slot jet 90 is large enough to cause the separation region 112 to be contained inside the slot, but not to extend beyond the outlet 94, as illustrated in FIG. 5. In one embodiment the divergence angle $\alpha$ is 20° or greater on each of the two sidewalls 100 of the slot jet 90. In another embodiment, the length 114 of the divergent section is selected so as to assure that any separation bubbles are washed out before the outlet 94 of the slot jet 90. Alternately, the diverging section may have curved walls that increase divergence with axial distance from the throat 108. In a subsonic slot jet 90, the ratio of the stagnation pressure at the inlet 92 to the static pressure at the outlet 94 may vary from about 1.2 to 1.8. In another embodiment that ratio is preferably 1.5.

As illustrated in FIG. 4, the top wall 94 of the converging-diverging fuel injection slot jet 90 forms a continuous surface with the wall profile 80 of the premixing device 70 so as to allow the fuel to be injected nearly tangentially with the accelerating mainstream flow of oxidizer along the surface that creates the Coanda effect. As such, a higher level of turbulence generated by the localized separation region 112 inside the converging-diverging fuel injection slot jet 90 is introduced into the fuel, thus increasing the mixing of the fuel and oxidizer.

Figure 6:
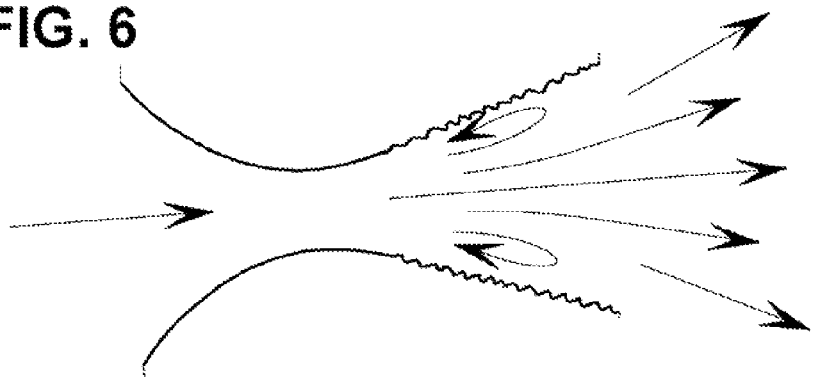
FIG. 6 illustrates a top view of another converging-diverging slot jet with rough walls in the diverging portion of the jet.
Figure 7:
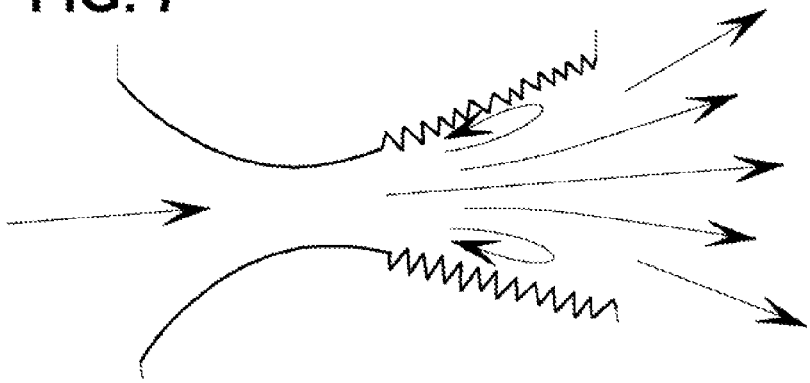
FIG. 7 illustrates a top view of yet another converging-diverging slot jet with jagged walls in the diverging portion of the jet.
Figure 8:
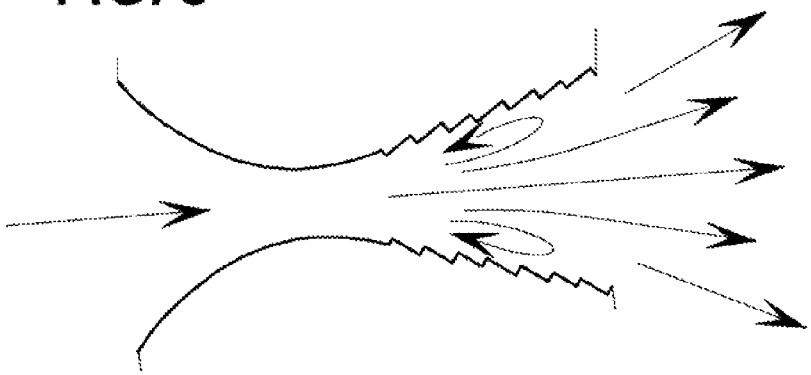
FIG. 8 illustrates a top view of yet another converging-diverging slot jet with stepped walls in the diverging portion of the jet.

In other embodiments of the invention the sidewalls 100 of the converging-diverging fuel injection slot jet 90 are modified so as to further enhance the development of turbulence as just explained. For example, FIG. 6 illustrates a first exemplary embodiment in which the sidewalls 100 are made rough along the divergent portion 110 in order to promote additional mixing, while reducing the likelihood that the separation region 112 will extend beyond the outlet 94. In FIG. 7, the sidewalls 100 are jagged along the divergent portion 110, and, in FIG. 8, the sidewalls are stepped along the divergent portion 110. Those of ordinary skill in the applicable arts will understand that other embodiments of the divergent portion to generate turbulence or small disruptions in the flow along those surfaces are within the scope of the disclosed invention besides the three exemplary illustrations shown in FIGS. 6-8. The features illustrated in FIGS. 6-8 disposed on each side wall, and other equivalents, should not constitute more than 5 to 20% blockage of the local cross-sectional flow area (as compared to a smooth surface embodiment), and preferably about 10% blockage.

In the disclosed premixing devices the fuel injected along the Coanda surface contains an enhanced level of turbulence generated by the converging-diverging fuel injection slot jet 90, thus more efficiently mixing with the oxidizer in a short distance while the potential for fuel separation and consequent auto-ignition or flame holding inside the mixing chamber is minimized and/or eliminated. The geometry for the fuel injection passages are such that the mixing of the fuel and oxidizer from the exit of the slot jets is further promoted by the fluid dynamics occurring inside the slot jet geometry, thus helping the achievement of an increased level of fuel-air mixedness in a short length, without liftoff or separation of the fuel along the injection surface or the diffuser wall of the mixing chamber. Those of ordinary skill in the art will understand that the disclosed invention covers a broad range of converging-diverging injection slot types that may be integrated with the Coanda surfaces of the premixing devices, resulting on an improved performance as compared to conventional discrete jet injection using round jets in cross flow.

Figure 9:
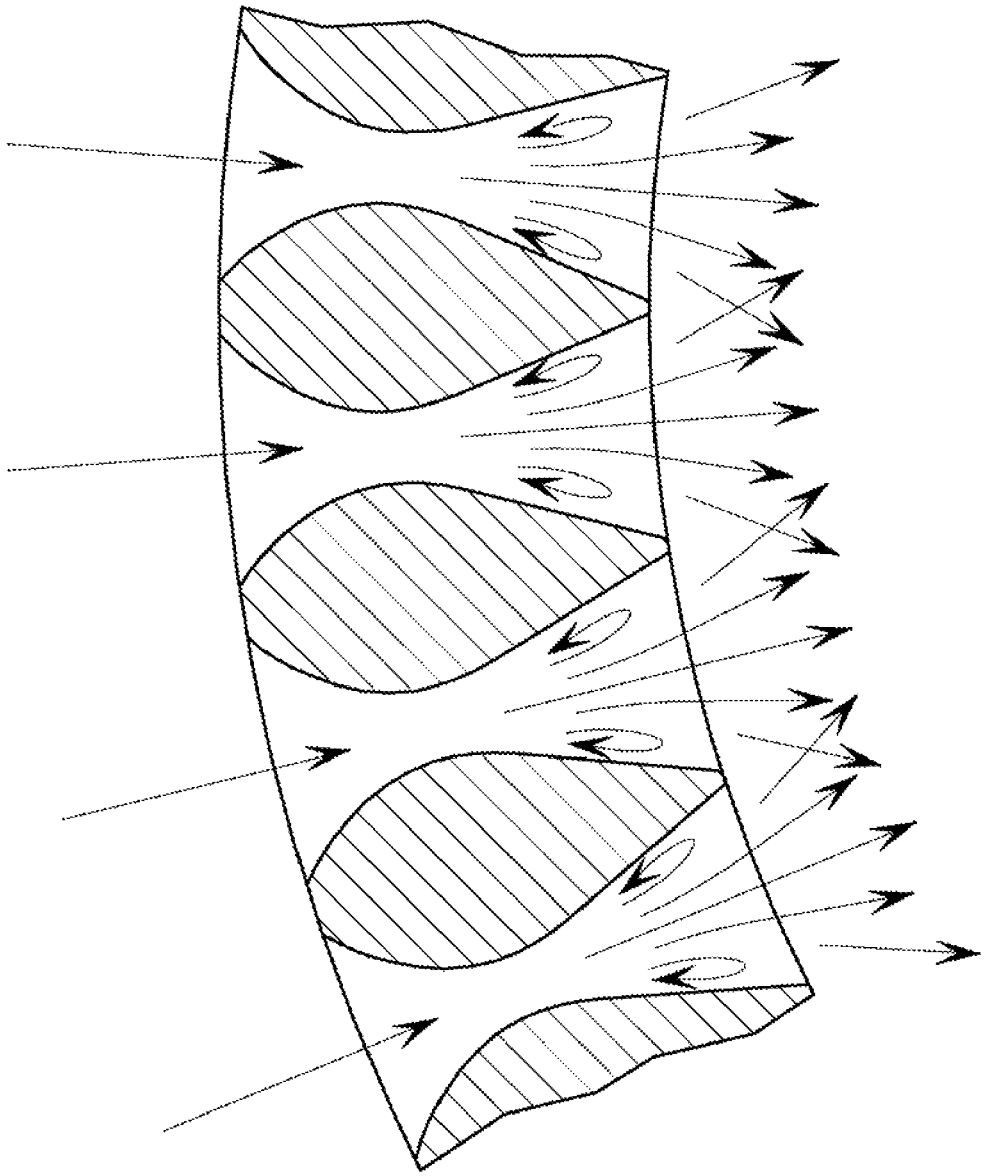
FIG. 9 illustrated a top view of a plurality of adjacent converging-diverging slot jets in accordance with aspects of the present technique.

In another embodiment of the disclosed invention, the premixing device 70 may also include a continuous fuel inlet slot, in which a plurality of adjacent internal converging-diverging fuel injection slot jets are disposed, as illustrated in FIG. 9. It should be clear that each one of the converging-diverging slots illustrated in FIG. 9 may also include the above-described sidewall modifications so as to further enhance the development of turbulence as just explained. When a plurality of adjacent internal converging-diverging fuel injection slot jets is placed adjacent to each other, the exit wall where any two adjacent slots come together should not form a bluff body wake region, thus potentially leading to a separated flow, and hence flame holding. Instead this junction should either meet within the divergent section to allow the separation to occur before the fuel and oxidizer meet, or the junction should be formed having a small radius feature, or sharp edge, such that no separation region can form. In one embodiment, a sharp junction could be made inside, at the slot exit, or even after the slot exit.

The converging-diverging fuel injection slot jet 90 of the instant invention may be formed as separate parts to be assembled into the premixing device 70. Alternatively, the slot jets 90 may also be formed as an integral part of the premixing device 70. In one particular embodiment the converging-diverging fuel injection slot jets are cast as an integral part of the premixing device 70.

The premixing devices described above may also be employed in gas-to-liquid system in order to enhance the premixing of oxygen and natural gas prior to reaction in a combustor of the system. Typically, a gas-to-liquid system includes an air separation unit, a gas processing unit and a combustor. In operation, the air separation unit separates oxygen from air and the gas-processing unit prepares natural gas for conversion in the combustor. The oxygen from the air separation unit and the natural gas from the gas-processing unit are directed to the combustor where the natural gas and the oxygen are reacted at an elevated temperature and pressure to produce a synthesis gas. In this embodiment, the premixing device is coupled to the combustor to facilitate the premixing of oxygen and the natural gas prior to reaction in the combustor. Further, at least one surface of the premixing device has a pre-determined profile, wherein the pre-determined profile deflects the oxygen to facilitate attachment of the oxygen to the profile to form a boundary layer, the converging-diverging slot jets generate localized turbulence without inducing a boundary layer flow separation inside of the mixing chamber, and the boundary layer entrains incoming natural gas to enable the mixing of the natural gas and oxygen at high fuel-to-oxygen equivalence ratios (e.g. about 3.5 up to about 4 and beyond) to maximize syngas production yield while minimizing residence time. In certain embodiment, steam may be added to the oxygen or the fuel to enhance the process efficiency.

The synthesis gas is then quenched and introduced into a Fischer-Tropsh processing unit, where through catalysis, the hydrogen gas and carbon monoxide are recombined into long-chain liquid hydrocarbons. Finally, the liquid hydrocarbons are converted and fractionated into products in a cracking unit. Advantageously, the premixing device based on the Coanda effect combined with the converging-diverging slot jets to generate localized turbulence without inducing a boundary layer flow separation inside of the mixing chamber induces rapid premixing of the natural gas and oxygen and a substantially short residence time in the gas to liquid system.

The various aspects of the method described hereinabove have utility in different applications such as combustors employed in gas turbines and heating devices, such as furnaces. Furthermore, the technique described here enhances the premixing of fuel and air prior to combustion, thereby substantially reducing emissions and enhancing the efficiency of systems like gas turbines and appliance gas burners. The premixing technique can be employed for different fuels such as, but not limited to, gaseous fossil fuels of high and low volumetric heating values including natural gas, hydrocarbons, carbon monoxide, hydrogen, biogas and syngas. Thus, the premixing device may be employed in fuel flexible combustors for integrated gasification combined cycle (IGCC) for reducing pollutant emissions. In addition, the premixing device may be employed in gas range appliances. In certain embodiments, the premixing device is employed in aircraft engine hydrogen combustors and other gas turbine combustors for aero-derivatives and heavy-duty machines. In particular, the premixing device described may facilitate substantial reduction in emissions for systems that employ fuel types ranging from low British Thermal Unit (BTU) to high hydrogen and pure hydrogen Wobbe indices. Further, the premixing device may be utilized to facilitate partial mixing of streams such as oxy-fuel that will be particularly useful for carbon dioxide free cycles and exhaust gas recirculation.

Thus, the premixing technique based upon the Coanda effect described above enables enhanced premixing and flame stabilization in a combustor. Further, the present technique enables reduction of emissions, particularly $NO_x$ emissions from such combustors, thereby facilitating the operation of the gas turbine in an environmentally friendly manner. In certain embodiments, this technique facilitates minimization of pressure drop across the combustors, more particularly in hydrogen combustors. In addition, the enhanced premixing achieved through the Coanda effect facilitates enhanced turndown (i.e., the ratio of the a burner's maximum firing capability to the burner's minimum firing capability), flashback resistance and increased flameout margin for the combustors.

In the illustrated embodiments, the fuel boundary layer is positioned along the walls via the Coanda effect resulting in substantially higher level of fuel concentration at the wall including at the outlet plane of the premixing device. Further, the turndown benefits from the presence of the higher concentration of fuel at the wall, thereby stabilizing the flame. Thus, the absence of a flammable mixture next to the wall and the presence of 100% fuel at the walls determine the absence of the flame in that region, thereby increasing flashback resistance. It should be noted that the flame is kept away from the walls, thus allowing better turndown and permitting operation on natural gas and air mixtures having an equivalence ratio as low as about 0.2. Additionally, the flameout margin is significantly improved as compared to existing systems. Further, as described earlier, this system may be used with a variety of fuels, thus providing enhanced fuel flexibility. For example, the system may employ either natural gas or $H_2$, for instance, as the fuel. The fuel flexibility of such system eliminates the need of hardware changes or complicated architectures with different fuel ports required for different fuels. As described above, the described premixing devices may be employed with a variety of fuels, thus providing fuel flexibility of the system. Moreover, the technique described above may be employed in the existing can or can-annular combustors to reduce emissions and any dynamic oscillations and modulation within the combustors. Further, the illustrated device may be employed as a pilot in existing combustors.

Methods for premixing a fuel and an oxidizer in a combustion system are also within the scope of the embodiments of the invention disclosed, such methods including the steps of drawing the oxidizer inside a premixing device through an oxidizer inlet, injecting the fuel into the premixing device through a converging-diverging fuel injection slot jet, deflecting the injected fuel towards a pre-determined wall profile within the premixing device to form a fuel boundary layer along an inside wall of the premixing device, and premixing the fuel and oxidizer to form a fuel-air mixture, wherein the premixing includes over expanding the fuel in a diverging portion of the converging-diverging fuel injection slot jet to create a flow separation region in the diverging portion, the flow separation region being confined to the diverging portion and being configured to generate mixing turbulence at an outlet of the converging-diverging fuel injection slot jet to aerodynamically enhance a mixing of the fuel from the boundary layer with the oxidizer without causing a boundary layer flow separation and a flame holding in the mixing chamber.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims. In addition, while the present invention has been shown in the drawings and fully described above with particularity and detail in connection with what is presently deemed to be practical and several of the exemplary embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed is:

1. A premixing device, comprising:

an air inlet;

a plurality of fuel inlet slots disposed around a circumference of the the premixing device and in flow communication with an end portion of the air inlet, the fuel inlet slots including a wall profile configured to form a fuel boundary layer along a portion of an inside wall of the premixing device;

a mixing chamber where compressed air from the air inlet is mixed with fuel from the boundary layer, the mixing chamber being disposed downstream of the air inlet and the fuel inlet slots; and at least one converging-diverging fuel injection slot jet, the at least one converging-diverging fuel injection slot jet disposed inside each fuel inlet slot, the at least one converging-diverging fuel injection slot jet being configured to create a flow separation region inside a portion thereof, the flow separation region being confined to the diverging portion of the at least one converging-diverging fuel injection slot jet and being configured to generate mixing turbulence at an outlet of the at least one converging-diverging fuel injection slot jet to aerodynamically enhance a mixing of the fuel from the boundary layer with the compressed air without causing a boundary layer flow separation and a flame holding in the mixing chamber.

2. The premixing device of claim 1, wherein the wall profile is configured to deflect the fuel supplied through a plurality of fuel inlet slots towards the wall profile by a Coanda effect and the at least one converging-diverging fuel injection slot jet comprises an inlet, a throat, a top wall, a bottom wall, and sidewalls, the sidewalls being shaped laterally to form a converging portion from the inlet to the throat and a diverging portion extending downstream of the throat to the outlet.

3. The premixing device of claim 1, wherein a height of the at least one converging-diverging fuel injection slot jet measured in a direction perpendicular to a direction of fuel flow is substantially constant.

4. The premixing device of claim 2, wherein a divergence angle of the diverging portion is about 20° or greater.

5. The premixing device of claim 2, wherein a divergence angle of the diverging portion increases as an axial distance from the throat increases.

6. The premixing device of claim 1, wherein the at least one converging-diverging fuel injection slot jet is subsonic and a ratio of a stagnation pressure at an inlet of the slot jet to a static pressure at the outlet varies from about 1.2 to 1.8.

7. The premixing device of claim 6, wherein the ratio is about 1.5.

8. The premixing device of claim 2, wherein the bottom wall of the at least one converging-diverging fuel injection slot jet forms a continuous surface with the wall profile so as to allow the fuel to be injected nearly tangentially with the compressed air flow.

9. The premixing device of claim 2, wherein the diverging portion of the sidewalls are rough.

10. The premixing device of claim 2, wherein the diverging portion of the sidewalls are jagged.

11. The premixing device of claim 2, wherein the diverging portion of the sidewalls are stepped.

12. The premixing device of claim 2, wherein a plurality of adjacent converging-diverging fuel injection slot jets is disposed inside the plurality of fuel inlet slots.

13. The premixing device of claim 1, wherein the at least one converging-diverging fuel injection slot jet is formed as an integral part of the plurality of fuel inlet slots.

14. The premixing device of claim 1, wherein the at least one converging-diverging fuel injection slot jet is formed as a separate part of an assembly comprising the plurality of fuel inlet slots.

15. A gas turbine combustor comprising the premixing device of claim 1, wherein the gas turbine combustor comprises a can combustor, or a can-annular combustor, or an annular combustor, and the fuel comprises natural gas, or high hydrogen gas, or hydrogen, or biogas, or carbon monoxide, or a syngas.

16. A gas range burner comprising the premixing device of claim 1, wherein the fuel comprises natural gas, or high hydrogen gas, or hydrogen, or biogas, or carbon monoxide, or a syngas.

17. A low-emission combustor, comprising:

a combustor housing defining a combustion area; and a premixing device coupled to the combustor, the premixing device comprising, an air inlet, fuel inlet slots disposed around a circumference of the premixing device and in flow communication with an end portion of the air inlet, the fuel inlet slots including . . . fuel supplied from the fuel inlet slots a mixing chamber where compressed air from the air inlet is mixed with fuel from the boundary layer, the mixing chamber being disposed downstream of the air inlet and the fuel inlet slots at least one converging-diverging fuel injection slot jet disposed inside each fuel inlet slot.

18. The combustor of claim 17, further comprising a swirler disposed adjacently to the premixing device.

19. The combustor of claim 17, wherein the pre-determined wall profile is configured to deflect the fuel supplied through the slot towards the wall profile by a Coanda effect.

20. A method for premixing a fuel and an oxidizer in a combustion system, comprising:

drawing the oxidizer inside a premixing device through an oxidizer inlet;

injecting the fuel into the premixing device through a plurality of fuel inlet slots disposed around a circumference of the premixing device, each fuel inlet slot comprising at least one converging-diverging fuel injection slot jet;

deflecting the injected fuel towards a pre-determined wall profile within the premixing device to form a fuel boundary layer along an inside wall of the premixing device; and premixing the fuel and oxidizer to form a fuel-air mixture, wherein the premixing comprises over expanding the fuel in a diverging portion of the at least one converging-diverging fuel injection slot jet to create a flow separation region in the diverging portion, the flow separation region being configured to generate mixing turbulence at an outlet of the at least one converging-diverging fuel injection slot jet to aerodynamically enhance a mixing of the fuel from the boundary layer with the oxidizer without causing a boundary layer flow separation and a flame holding in the mixing chamber.

21. The method of claim 20, wherein the oxidizer comprises air or an oxidizer having a volumetric content of about 10% oxygen.

22. The method of claim 20, wherein the fuel comprises syngas and the oxidizer comprises high purity oxygen for use in oxy-fuel combustors.

23. The method of claim 20, wherein the deflecting further comprises inducing a Coanda effect via the pre-determined wall profile.

24. A gas turbine, comprising:

a compressor;

a combustor in flow communication with the compressor configured to burn a premixed mixture of fuel and air, the combustor including a premixing device disposed upstream of the combustor, the premixing device, comprising an air inlet, a plurality of fuel inlet slots disposed around a circumference of the premixing device and in flow communication with an end portion of the air inlet, the fuel inlet slots including a mixing chamber where compressed air from the air inlet is mixed with fuel from the boundary layer, the mixing chamber being disposed downstream of the air inlet and the fuel inlet slots at least one converging-diverging fuel injection slot jet disposed inside each fuel inlet slot a turbine located downstream of the combustor and configured to expand the combustor exit gas stream.

25. A gas to liquid system, comprising:

an air separation unit configured to separate oxygen from air;

a gas processing unit for preparing natural gas;

a combustor for reacting oxygen with the natural gas at an elevated temperature and pressure to produce a synthesis gas-enriched with carbon monoxide and hydrogen gas;

a premixing device disposed upstream of the combustor to facilitate the premixing of oxygen and the natural gas prior to reaction in the combustor, the premixing device, comprising an air inlet, a plurality of fuel inlet slots disposed around a circumference of the premixing device and in flow communication with an end portion of the air inlet, the fuel inlet slots including a mixing chamber where compressed air from the air inlet is mixed with fuel from the boundary layer, the mixing chamber being disposed downstream of the air inlet and the fuel inlet slots at least one converging-diverging fuel injection slot jet disposed inside each fuel inlet slot, a turbo-expander in flow communication with the combustor for extracting work from and for quenching the synthesis gas.

* * * * *

UNITED STATES PATENT AND TRADEMARK OFFICE

CERTIFICATE OF CORRECTION

PATENT NO. : 7,832,212 B2
APPLICATION NO. : 11/558760
DATED : November 16, 2010
INVENTOR(S) : Bunker It is certified that error appears in the above-identified patent and that said Letters Patent is hereby corrected as shown below:

In Column 11, Line 66, in Claim 1, delete "the the" and insert -- the --, therefor.

In Column 13, Lines 16-17, in Claim 17, delete "including ... fuel supplied from the fuel inlet slots" and insert -- including a pre-determined wall profile adjacent thereto, the predetermined profile being configured to form a boundary layer of fuel supplied from the fuel inlet slots along a portion of an inside wall of the premixing device, --, therefor.

In Column 13, Line 21, in Claim 17, delete "slots" and insert -- slots, and --, therefor.

In Column 13, Line 23, in Claim 17, delete "slot." and insert -- slot, the at least one converging-diverging fuel injection slot jet being configured to create a flow separation region in a diverging portion thereof, the flow separation region being confined to the diverging portion and being configured to generate mixing turbulence at an outlet of the at least one converging-diverging fuel injection slot jet to aerodynamically enhance a mixing of the fuel from the boundary layer with the compressed air without causing a boundary layer flow separation and a flame holding in the mixing chamber. --, therefor.

In Column 14, Line 18, in Claim 24, delete "including" and insert -- including a wall profile configured to form a fuel boundary layer along a portion of an inside wall of the premixing device, --, therefor.

In Column 14, Line 22, in Claim 24, delete "slots" and insert -- slots, and --, therefor.

In Column 14, Line 24, in Claim 24, delete "slot" and insert -- slot, the at least one converging-diverging fuel injection slot jet being configured to create a flow separation region in a diverging portion thereof, the flow separation region being confined to the diverging portion and being configured to generate mixing turbulence at an outlet of the at least one converging-diverging fuel injection slot jet to aerodynamically enhance a mixing of the fuel Signed and Sealed this
Thirtieth Day of August, 2011

David J. Kappos

David J. Kappos
*Director of the United States Patent and Trademark Office* from the boundary layer with the compressed air without causing a boundary layer flow separation and a flame holding in the mixing chamber; and --, therefor.

In Column 14, Line 34, in Claim 25, delete “gas-enriched” and insert -- gas enriched --, therefor.

In Column 14, Line 43, in Claim 25, delete “including” and insert -- including a wall profile configured to form a fuel boundary layer along a portion of an inside wall of the premixing device, --, therefor.

In Column 14, Line 47, in Claim 25, delete “slots” and insert -- slots, and --, therefor.

In Column 14, Line 49, in Claim 25, delete “slot,” and insert -- slot, the at least one converging-diverging fuel injection slot jet being configured to create a flow separation region in a diverging portion thereof, the flow separation region being confined to the diverging portion and being configured to generate mixing turbulence at an outlet of the at least one converging-diverging fuel injection slot jet to aerodynamically enhance a mixing of the fuel from the boundary layer with the compressed air without causing a boundary layer flow separation and a flame holding in the mixing chamber; and --, therefor.